US006904964B2

(12) United States Patent
Koizumi et al.

(10) Patent No.: US 6,904,964 B2
(45) Date of Patent: Jun. 14, 2005

(54) HEAT EXCHANGER CORE, AND METHOD OF ASSEMBLING THE HEAT EXCHANGER CORE

(75) Inventors: Hiroyasu Koizumi, Tokyo (JP); Hiroshi Chikuma, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/461,211

(22) Filed: Dec. 15, 1999

(65) Prior Publication Data

US 2002/0053423 A1 May 9, 2002

(30) Foreign Application Priority Data

Dec. 15, 1998 (JP) ..... 10-355699
Feb. 18, 1999 (JP) ..... 11-039704
Dec. 6, 1999 (JP) ..... 11-345690

(51) Int. Cl.[7] ..... F28F 9/02
(52) U.S. Cl. ..... 165/149; 165/67; 165/153
(58) Field of Search ..... 165/67, 149, 153

(56) References Cited

U.S. PATENT DOCUMENTS 4,332,293 A * 6/1982 Hiramatsu ..... 165/153
5,052,475 A * 10/1991 Grundy ..... 165/149
5,101,887 A * 4/1992 Kado ..... 165/76
5,197,538 A * 3/1993 Nagasaka et al. ..... 165/149
5,265,672 A * 11/1993 Aoki ..... 165/149
5,535,819 A 7/1996 Matsuura ..... 165/149
5,662,162 A 9/1997 Fukuoka et al. ..... 165/41
5,685,075 A * 11/1997 Kato ..... 29/890.054
5,868,198 A 2/1999 Kato ..... 165/153
5,894,885 A 4/1999 Paquet ..... 165/134.1
6,012,513 A * 1/2000 Iokawa et al. ..... 165/149

FOREIGN PATENT DOCUMENTS

| | | | | |
|---|---|---|---|---|
| DE | 4120869 | * | 1/1993 | ..... 165/149 |
| EP | 1398590 A2 | * | 3/2004 | |
| GB | 2064751 | * | 6/1981 | ..... 165/149 |
| JP | 61-25734 | | 2/1986 | |
| JP | 3-87063 | | 9/1991 | |
| JP | 3-279798 | | 12/1991 | |
| JP | 404244596 | * | 9/1992 | ..... 165/149 |
| JP | 404288485 | * | 10/1992 | ..... 165/67 |
| JP | 405248783 | * | 9/1993 | ..... 165/149 |
| JP | 6-7871 | * | 1/1994 | |
| JP | 9-113153 | * | 10/1995 | |
| JP | 7-329550 | * | 12/1995 | |
| JP | 8-5280 | * | 1/1996 | |
| JP | 9-68397 | * | 3/1997 | |
| JP | 9-085541 | | 3/1997 | |
| JP | 10-197189 | * | 7/1998 | |

OTHER PUBLICATIONS

Full translation of Kokai Utility Model No. HEI 3 [1991] –87063, published Sep. 4, 1991, inventor: Satoko Matsuzawa, assigned to Calsonic Corporation.*
Partial English Translation of Reference JP–087063 (7 pgs.).

* cited by examiner

*Primary Examiner*—John K. Ford
(74) *Attorney, Agent, or Firm*—Foley & Lardner LLP

(57) ABSTRACT

Reinforcement holes and tube holes are formed so as to be of the same size, and the interval between the reinforcement hole and the tube hole adjacent to the reinforcement hole is made equal to the interval between the adjacent tube holes.

16 Claims, 11 Drawing Sheets

FIG. 13
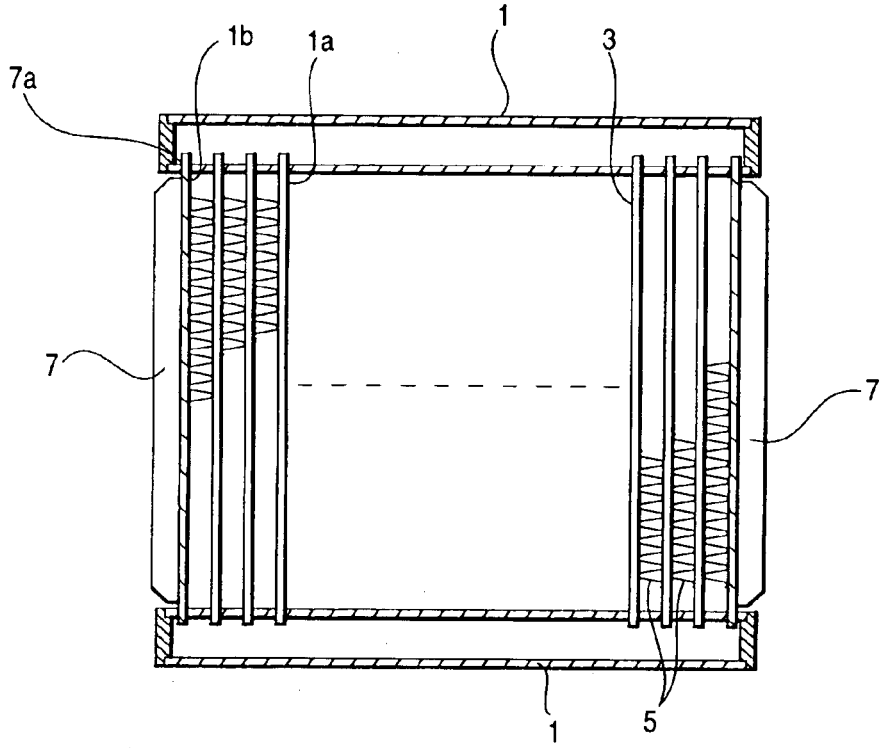
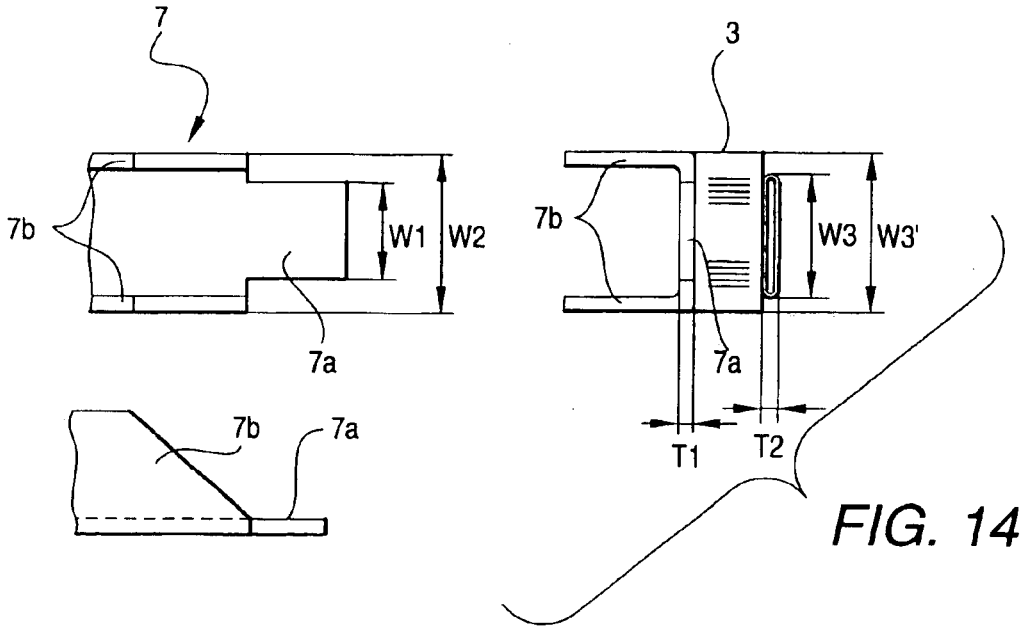
FIG. 14

HEAT EXCHANGER CORE, AND METHOD OF ASSEMBLING THE HEAT EXCHANGER CORE

BACKGROUND OF THE INVENTION

1. Field of the Invention

The present invention relates to a heat exchanger core constituted by connecting opposite ends of a header member with corresponding opposite ends of another header member, the latter header member being positioned opposite the former header member through use of reinforcement members, as well as to a method of assembling the heat exchanger core.

The present application is based on Japanese Patent Applications No. Hei. 10-355699, 10-39704, and 11-345690 which are incorporated herein by reference.

2. Description of the Related Art

A core structure constituted by connecting opposite ends of a header member with corresponding opposite ends of another header member has already been known as the core of a heat exchanger, such as a radiator.

FIG. 13 shows the structure of a heat exchanger core of this type. In the heat exchanger core, header members 1, each comprising a header tank, are spaced away from and disposed opposite each other. Between the header members 1, tubes 3 and corrugated fins 5 are alternately arranged. The ends of one of the headers member 1 are connected to the corresponding ends of the remaining header member 1 by means of reinforcement members 7.

More specifically, as shown in FIG. 14, in the heat exchanger core of conventional structure, the reinforcement member 7 comprises the reinforcing section 7*b* having a C-shaped cross section and the insertion sections 7*a* which are continuous with the reinforcing section 7*b* and are to be inserted into the corresponding reinforcement holes 1*b*. The thickness T1 of the reinforcement member 7, which is designed in terms of strength, is thinner than the thickness T2 of the tube 3. Further, the width W1 of the insertion section 7*a* is set to be smaller than the width W3 of the tube 3.

The ends of the respective tubes 3 are inserted into tube holes 1*a* formed in the header member 1, and the ends of the reinforcement member 7 are inserted into reinforcement holes 1*b* formed in the header member 1. In this state, the header members 1, the tubes 3, the corrugated fins 5, and the reinforcement members 7 are connected together by means of brazing conducted within a heat treatment furnace.

More specifically, in the core structure of such a heat exchanger, insertion sections 7*a* as the ends of the reinforcement members 7 are fitted into the reinforcement holes 1*b* formed in the header members 1 and are fastened on the header members 1 by means of brazing. Accordingly, the reinforcement members 7 can reinforce the base ends of the tubes 3 attached to the both sides of the core structure, thus, four corners of the core structure on a plan view which are the most weak portions in the core structure.

As shown in FIG. 15, in the core structure of such a heat exchanger, the tubes 3 and the corrugated fins 5 are arranged alternately, with the reinforcement members 7 being provided at either end in the direction of arrangement, to thereby constitute a core section 10. In this state, the header members 1 are attached to opposite ends of the core section 10.

The corrugated fins 5 and reinforcing sections 7*b* of the reinforcement members 7 formed by bending so as to have a C-shaped cross section are guided along a horizontal guide surface 8*a* formed on a base member 8. Further, opposite ends of the respective tubes 3 are guide to individual tube guides 9 provided on opposite ends of the base member 8.

Further, as shown in FIG. 14, in the structure of the heat exchanger core, the width W2 of the reinforcing section 7*b* is set to be equal to the width W3' of the corrugated fin 5.

As shown in FIG. 16, in the heat exchanger core of conventional structure, the tube hole 1*a* and the reinforcement hole 1*b*, both being formed in the header member 1, differ in size from each other. In order to simultaneously form both the tube holes 1*a* and the reinforcement holes 1 in the header member 1, die assemblies for punching purposes corresponding to the length of the header member 1 must be prepare, thereby resulting in an increase in the number of types of die assemblies and hence adding to manufacturing costs.

Further, in the above method of assembling the heat exchanger core, the reinforcing sections 7*b* of the reinforcement members 7 are guided along the guide surface 8*a* of the base member 8 as shown in FIG. 15. It is very difficult to form the reinforcing section 7*b* of the reinforcement member 7 by bending with a high degree of accuracy, so machined dimensions of the reinforcement member 7 vary widely. Therefore, the center of the insertion section 7*a* of the reinforcement member 7 and the center of the reinforcement hole 1*b* are shifted from each other with respect to the widthwise direction of the header member 1, thus causing a problem of faulty insertion.

SUMMARY OF THE INVENTION

The present invention has been conceived to solve the problem of the traditional heat exchanger core and is aimed at providing a heat exchanger core whose tube holes and reinforcement holes can be formed through use of single or fewer die assemblies even when header members have different lengths.

The present invention is also aimed at providing a heat exchanger core which prevents a deviation between the center of a reinforcement hole and the center of an insertion section with respect to the widthwise direction of the header member, which would otherwise be caused when the core is inserted into header members, to a much greater extent than in a heat exchanger core of conventional structure.

According to the present invention, there is provided a heat exchanger core comprising: a pair of header members being spaced with a predetermined clearance therebetween and disposed opposite to each other; tubes and corrugated fins which are interposed between the pair of header members and are arranged alternately; and a reinforcement member being provided on ends of the mutually-opposing header members. Each of the header members has tube holes into which ends of the tubes are fixedly inserted and reinforcement holes into which ends of the reinforcement members are fixedly inserted. Each of the reinforcement holes is formed so as to be of the same size as or larger than each of the tube holes. Further, an interval between the reinforcement hole and the tube hole adjacent to the reinforcement hole is made equal to an interval between adjacent tube holes.

Preferably, the reinforcement hole is formed so as to be of the same size as each of the tube holes.

More preferably, the reinforcement hole comprises circular-arch sections being formed at both ends thereof and a linear section being formed between the circular-arch sections, an insertion section is formed at the end of the reinforcement member so as to have a rectangular cross section and be fixedly inserted into the reinforcement hole, and a width of the insertion section is made smaller than a width of the reinforcement hole as well as larger than a length of the linear section so that the insertion section is inserted into the reinforcement holes by press-fitting.

An interval between the linear section on a side of the adjacent tube hole of the reinforcement hole and an end face of the header member may be made smaller than a value obtained by adding a size of a shorter side of the tube hole to the interval between the adjacent tube holes.

Further, according to the present invention, each of the header members has tube holes into which ends of the tubes are fixedly inserted and reinforcement holes into which ends of the reinforcement members are fixedly inserted. The reinforcement member comprises a reinforcing section having a C-shaped cross section and insertion sections which are integrally formed with opposite ends of the reinforcing section, and a width of the reinforcement member is smaller than a width of the corrugated fin.

Preferably, a width of the insertion section of the reinforcement member is substantially equal to a width of the tube.

More preferably, notches are formed on opposite sides of a base end section of the insertion section of the reinforcement member.

More preferably, chamfered sections are formed on opposite sides of a tip end of the insertion section.

Still further, according to the present invention, a method of assembling a heat exchanger core comprising steps of: guiding fins along a horizontal guide surface formed in a base member; guiding both ends of tubes and insertion sections of reinforcement members into tube guides which are provided on opposite sides of the base member while arranging alternately the fins and the tubes; placing the reinforcement members at either end in the direction of arrangement of the fins and the tubes to thereby constitute a core section; and attaching header members to opposite sides of the core section.

In the structure of the heat exchanger core of the present invention, the size of the reinforcement hole is formed so as to be greater than the size of the tube hole, and the interval between the reinforcement hole and the tube hole adjacent to the reinforcement hole is made equal to the interval between adjacent tube holes.

In the structure of the heat exchanger core of the present invention, the reinforcement holes and the tube holes are formed so as to be of the same size.

In the structure of the heat exchanger core of the present invention, circular-arch sections are formed on opposite sides of the reinforcement hole, and the end of the reinforcement member having a rectangular cross section is inserted into the circular-arch section by press-fitting.

In the heat exchanger core of the present invention, the interval between the reinforcement hole and the end face of the header member is made smaller than a value obtained by adding the size of a shorter side of the tube hole to the interval between adjacent tube holes. Accordingly, formation of undesired tube holes at the end of the header member can be prevented unfailingly.

In the heat exchanger core of the present invention, the width of the reinforcing section of the reinforcement member is made smaller than the width of the corrugated fin. At the time of assembly of the heat exchanger core, the opposite sides of the respective tubes and the insertion sections of the reinforcement members are guided by tube guides for guiding corrugated fins disposed on opposite sides of the base member.

In the heat exchanger core of the present invention, the width of the insertion section of the reinforcement member is made substantially equal to the width of the tube. Hence, when the opposite sides of the respective tubes and the insertion sections of the reinforcement members are guided by tube guides, the center of the tube hole can be made substantially flush with the center of the reinforcement hole with respect to the widthwise direction of the header member.

In the heat exchanger core of the present invention, notches are formed on opposite sides of the base end of the insertion section of the reinforcing section.

In the heat exchanger core of the present invention, chamfered sections are formed on opposite sides of the tip end of the insertion section.

According to the method of assembling a heat exchanger core of the present invention, the opposite sides of the tubes and the insertion sections of the reinforcement members are guided into the tube guides that are disposed on opposite sides of the base member, to thereby constitute a core section. In this state, the header members are attached to opposite sides of the core section.

Features and advantages of the invention will be evident from the following detailed description of the preferred embodiments described in conjunction with the attached drawings.

BRIEF DESCRIPTION OF THE DRAWINGS

In the accompanying drawings:

FIG. 13 is a cross-sectional view showing a heat exchanger core of a conventional structure;

FIG. 14 is a descriptive view showing a conventional reinforcement member;

DETAILED DESCRIPTION OF THE PREFERRED EMBODIMENTS

An embodiment of the present invention will be described in detail hereinbelow by reference to the accompanying drawings.

Figure 1:
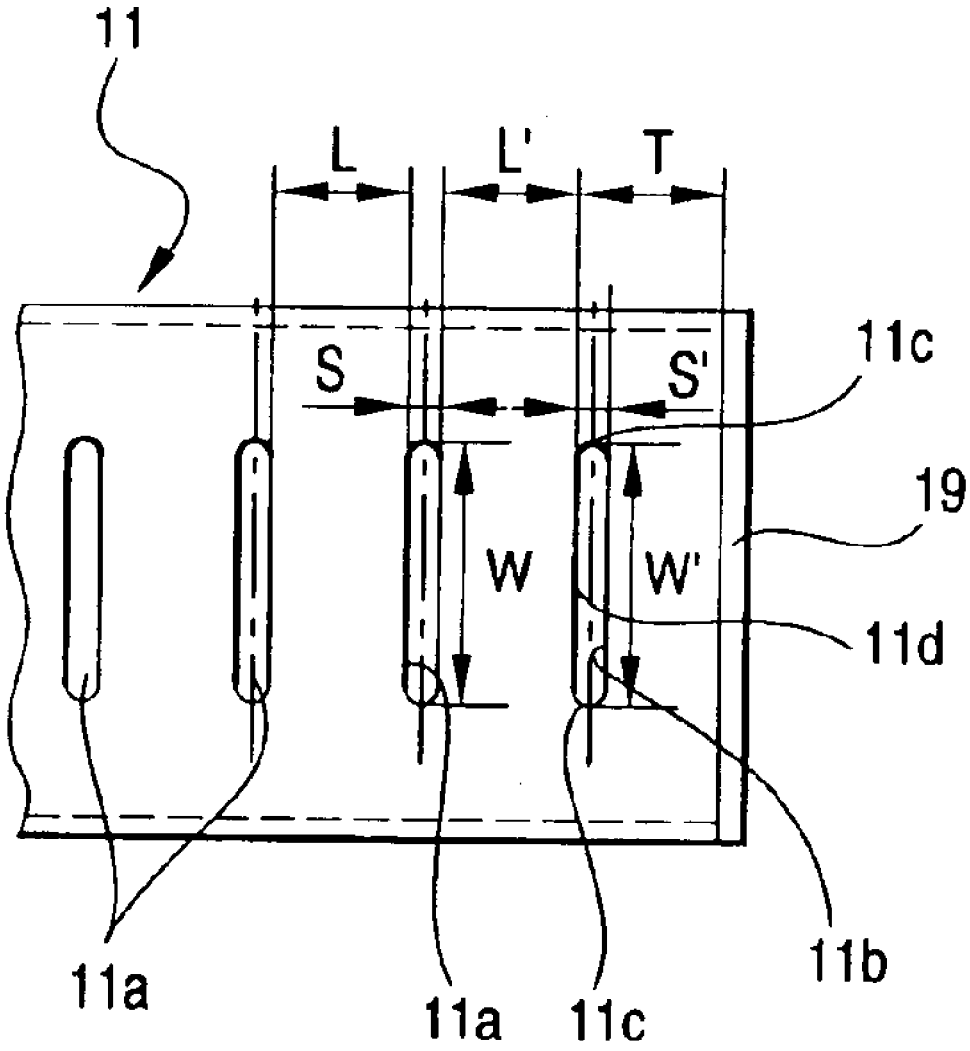
FIG. 1 is a bottom view showing details of a header member shown in FIG. 2.
Figure 2:
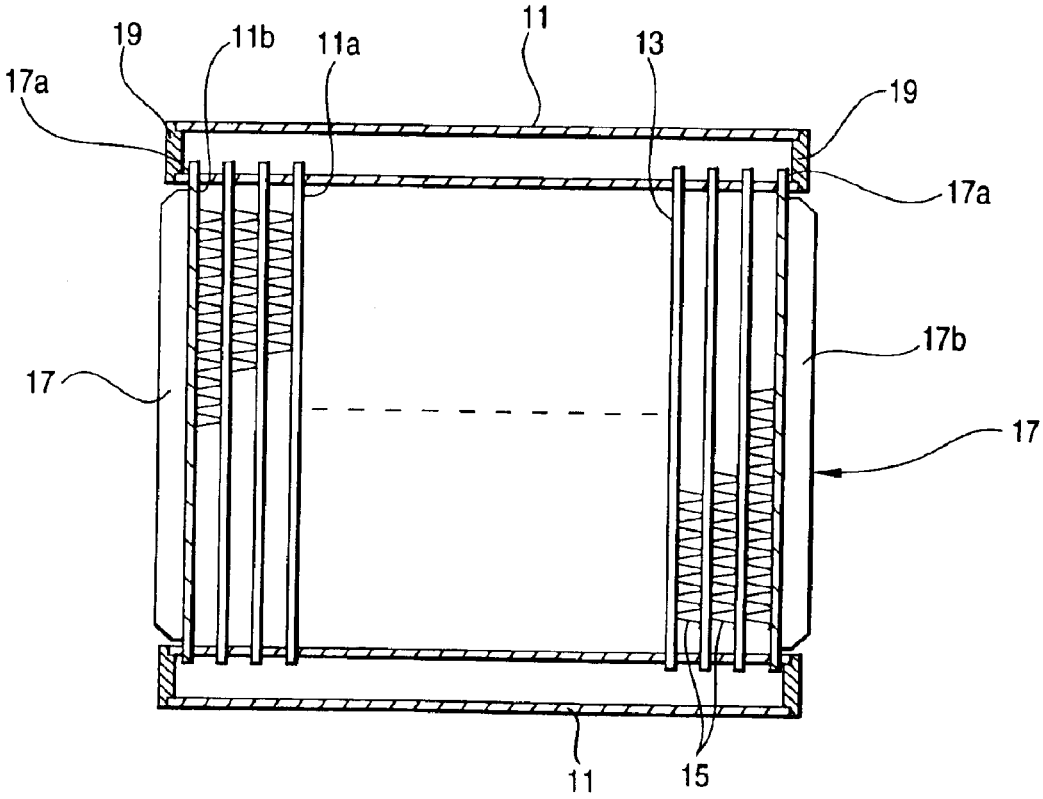
FIG. 2 is a cross-sectional view showing a heat exchanger core of structure according to one embodiment of the present invention.

FIG. 1 shows a main part of FIG. 2 in detail, and FIG. 2 shows an embodiment of a heat exchanger core according to the present invention.

In FIG. 1, reference numeral 11 designates a pair of header members each of comprising a header tank, which are spaced apart with a clearance therebetween and are disposed opposite each other in a vertical direction.

Tube holes 11*a* are formed in each of the header members 11 at predetermined intervals in the longitudinal direction of the header member 11, and tubes 13 are fitted to the respective tube holes 11*a*.

Further, corrugated fins 15 and the tubes 13 are arranged alternately.

The ends of each of the header members 11 are connected to corresponding ends of the other header member 11 by means of reinforcement members 17.

A reinforcement hole 11*b* is formed in each of the ends of the header member 11, and an insertion section 17*a* of the reinforcement member 17 is fitted into and fixed to the reinforcement hole 11*b* by means of brazing.

A patch end 19 is attached to each of the opposite ends of the header 11.

In the present embodiment, the header members 11, the patch ends 19, the tubes 13, the corrugated fins 15, and the reinforcement members 17 are formed from aluminum. For example, after having been coated with non-corrosive flux, these elements are mutually brazed within a heat treatment furnace.

The header members 11, the patch ends 19, and the tubes 13 are made of clad material whose interior surface is coated with a sacrificial corrosive layer and whose exterior surface is coated with a brazing layer.

The reinforcement member 17 is made of clad material whose both sides are coated with a brazing layer, and the corrugated fins 15 are made of bare material.

As shown in FIG. 1 in the present embodiment, the reinforcement hole 11*b* and the tube hole 11*a* of the header member 11 are formed so as to be of the same size (W=W', S=S').

Further, the interval L' between the reinforcement hole 11*b* and the tube hole 11*a* adjacent to the reinforcement hole 11*b* is made equal to the interval L between the adjacent tube holes 11*a*.

The interval T between a linear section 11*d* on the side of the adjacent tube hole 11*a* of the reinforcement hole 11*b* and the end face of the header member 11 is made smaller than a value obtained by adding a size S of a shorter side of the tube hole 11*a* to the interval L between the adjacent tube holes 11*a*.

Figure 3:
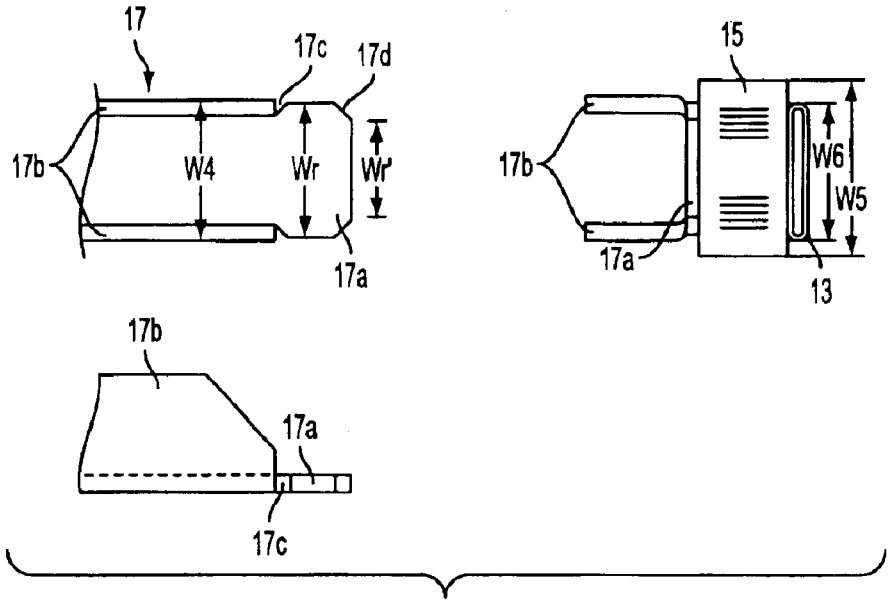
FIG. 3 is a descriptive view showing the relationship between the size of a reinforcement member and the size of a corrugated fin.

FIG. 3 shows details of the reinforcement member 17. The reinforcement member 17 comprises a reinforcing section 17*b* having a C-shaped cross section, and insertion sections 17*a* which are to be fitted to the corresponding reinforcement holes 11*b* and are integrally formed with opposite sides of the reinforcing section 17*b*.

Notches 17*c* are formed on opposite sides of the base end of the insertion section 17*a*. The width W4 of the reinforcing section 17*b* is made smaller than the width W5 of the corrugated fin 15.

Further, the width Wr of the insertion section 17*a* is made substantially equal to the width W6 of the tube 13.

Chamfered sections 17*d* are formed in opposite sides of the tip end of the insertion section 17*a*.

Figure 4A:
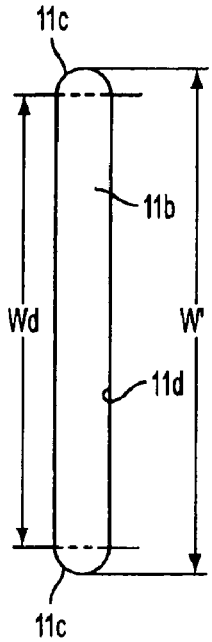
FIGS. 4A to 4C are descriptive views showing the relationship between the size of the reinforcement member and the size of a reinforcement hole.
Figure 4B:
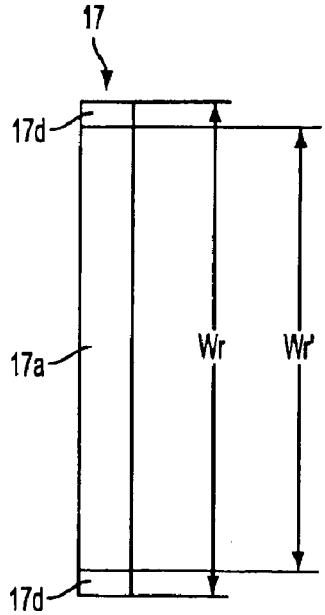
Figure 4C:
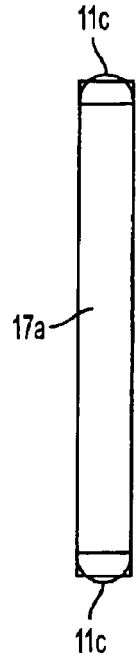

FIGS. 4A to 4C show details relating to the relationship between the reinforcement hole 11*b* and the reinforcement member 17. In the embodiment, as shown in FIG. 4A, the reinforcement hole 11*b* comprises the linear section 11*d* and circular-arch sections 11*c* which are continuous with opposite ends of the linear section 11*d*.

As shown in FIG. 4B, the insertion section 17*a* of the reinforcement member 17 has a rectangular cross section. The width of the linear section 11*d* is the width Wd, while the width of the narrowest part of the insertion section is Wr'.

Strictly speaking, the width W' of the reinforcement hole 11*b* is made larger than the width Wr of the insertion section 17*a* of the reinforcement member 17 by about 0.2 to 0.4 mm As shown in FIG. 4C, the insertion section 17*a* of the reinforcement member 17 is inserted into the circular-arc sections 11*c* of the reinforcement hole 11*b* by press-fitting.

Accordingly, the reinforcement member 17 can be sturdily supported on and fitted into the reinforcement hole 11*b*, thereby improving the brazing characteristic of the reinforcement hole.

Figure 5:
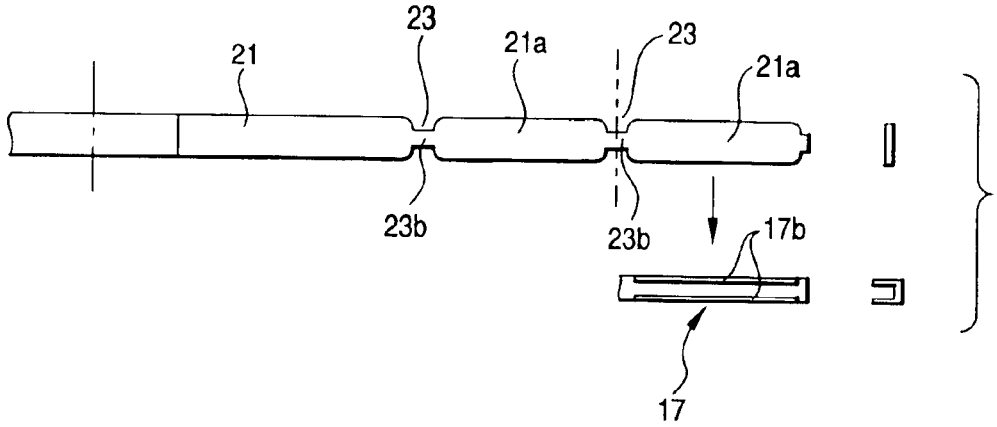
FIG. 5 is a descriptive view showing a method of producing the reinforcement member shown in FIG. 1.
Figure 6:
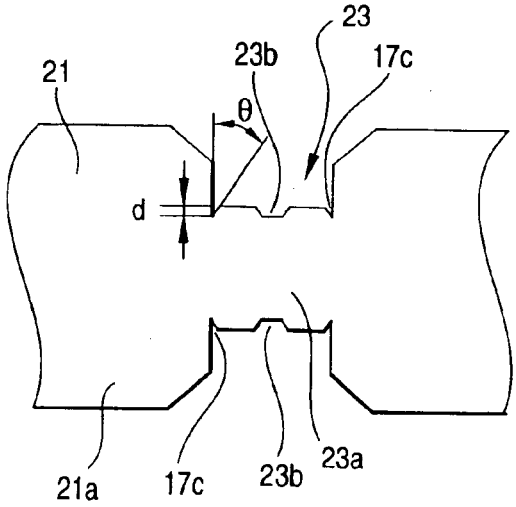
FIG. 6 is an enlarged view showing details of notches shown in FIG. 5.

FIG. 5 shows a method of producing the reinforcement member 17. Under this method, coil material 21 formed from aluminum clad is continually supplied, and notches 23 are formed in the coil material 21 at regular intervals.

As shown in FIG. 5, a rectangular joint section 23*a* which is to be divided into a pair of the insertion sections 17*a* is formed in the notch 23, and a main body section 21*a* which is to be formed into the reinforcing section 17*b* is formed on each side of the joint section 23*a*.

The notches 17*c* are formed on opposite sides of the base end of the joint section 23*a*. The notch 17*c* is cut at an angle θ of; for example, 15° to 60° and to a depth "d" of; for example, 0.5 to 1.5 mm.

A notch groove 23*b* which is to be divided into a pair of the chamfered sections 17*d* is formed in each of opposite sides of the center portion of the joint section 23*a*.

As shown in FIG. 5, the coil material 21 is cut along the centerline running through the notch grooves 23.

Finally, the longitudinal side edges of the main body section 21*a* are bent along the notches 17*c*, to thereby form the reinforcing section 17*b* having a C-shaped cross section. Thus, there is produced the reinforcement member 17.

Figure 7:
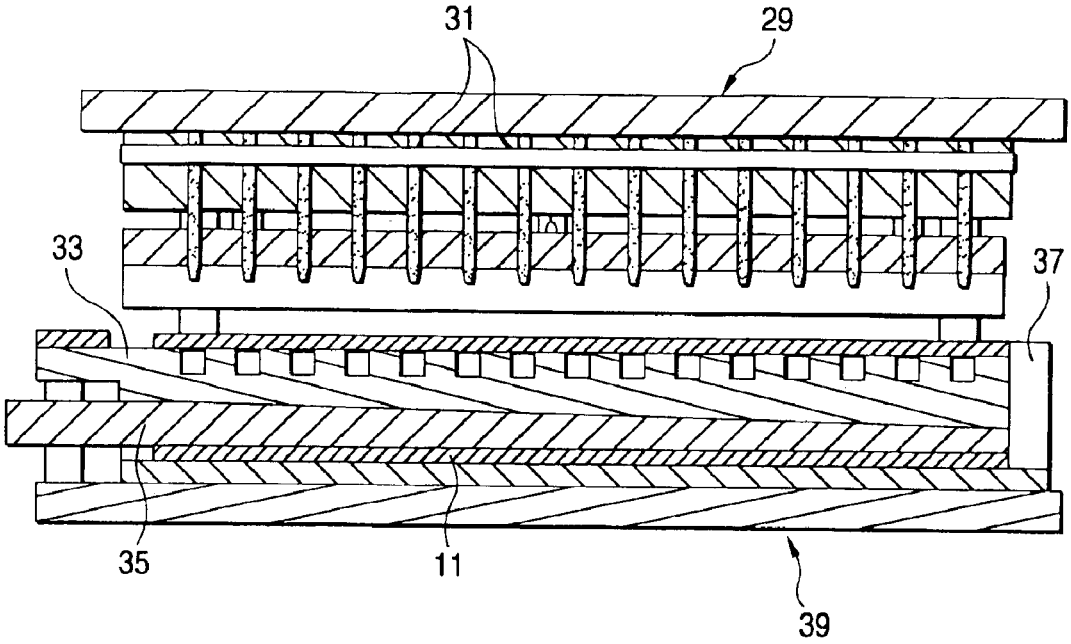
FIG. 7 is a descriptive view showing a method of forming tube holes and reinforcement holes in the header member shown in FIG. 1.

FIG. 7 shows a process of forming the tube holes 11*a* and the reinforcement holes 11*b* in the header member 11. In this process, the tube holes 11*a* and the reinforcement holes 11*b* are formed in the header member 11, by means of pressing punching members 31, which are disposed at regular intervals on the upper die 29 in its longitudinal direction, into the header member 11 while the header member 11 is retained between the upper die 29 and the lower die 39.

In the present embodiment, a punching-members receiving member 33 and a backing-up bar 35 are inserted into the header member 11 having a rectangular cylindrical shape, and the header member 11 is placed in position by means of an abutment plate 37.

Figure 8:
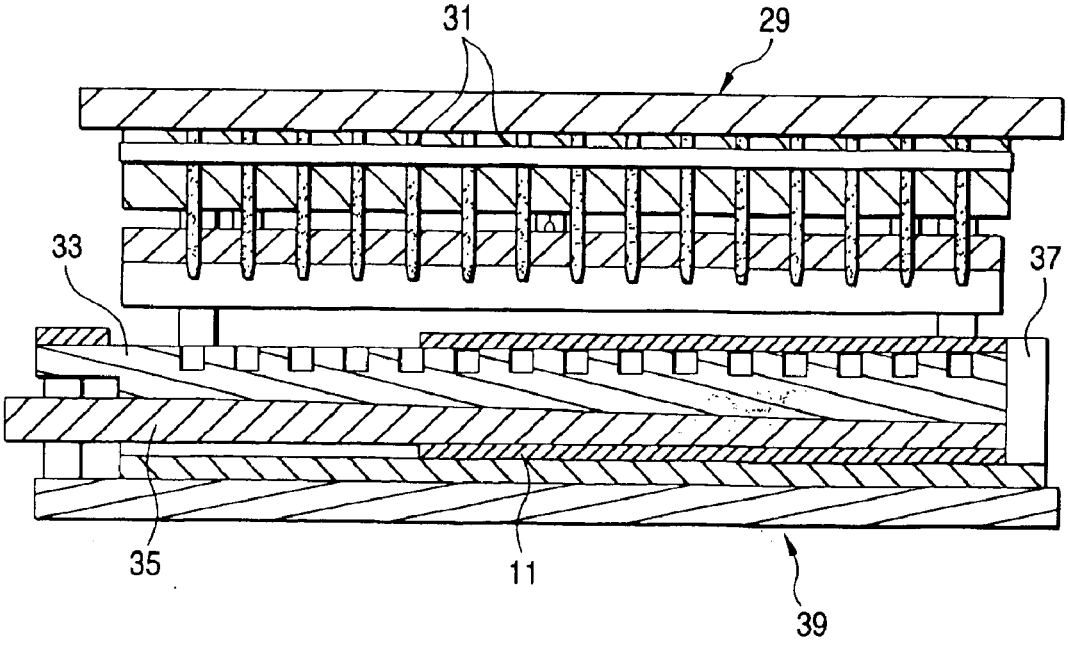
FIG. 8 is descriptive view showing a method of forming tube holes and reinforcement holes when the head member is shorter than that shown in FIG. 7.

As shown in FIG. 8, in a case where the header members 11 have different lengths, the header member 11 is brought into contact with the abutment plate 37, and the punching members 31 disposed closer to the abutment plate 37 forms the tube holes 11*a* and the reinforcement holes 11*b*.

Figure 9:
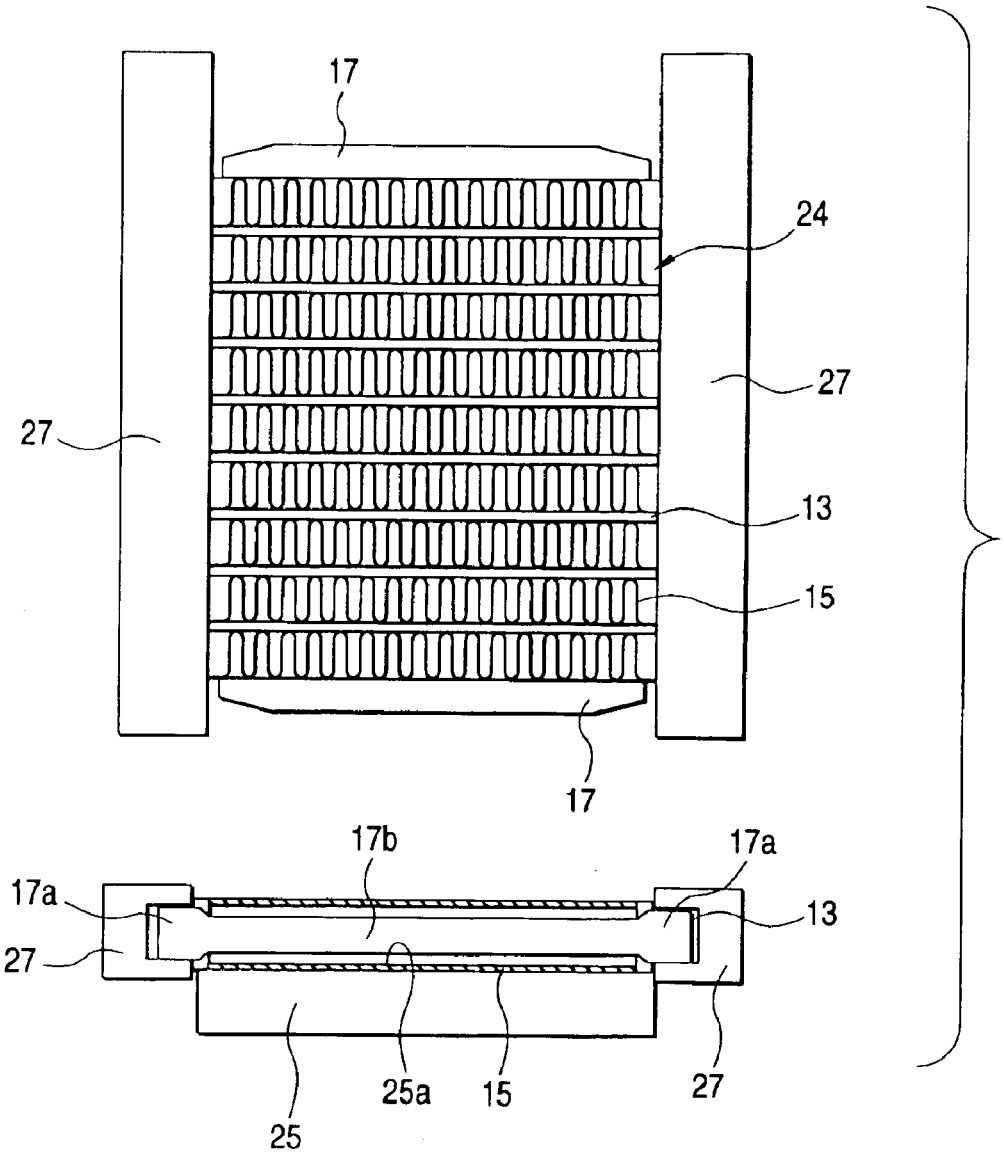
FIG. 9 is a descriptive view showing a process of assembling the heat exchanger core shown in FIG. 2.

FIG. 9 shows a process of assembling the heat exchanger core of the present embodiment. In the embodiment, the tubes 13 and the corrugated fins 15 are arranged alternately, with the reinforcement members 17 being provided at either end in the direction of arrangement, to thereby constitute a core section 24. In this state, the header members 11 are attached to opposite ends of the core section 24.

In this state, only the corrugated fins 15 are guided along a horizontal guide surface 25*a* formed in the base member 25.

Tube guides 27 are disposed on opposite ends of the base member 25, and the opposite ends of the respective tubes 13 and the insertion sections 17*a* of the reinforcement members 17 are guided by tube guides 27.

In this state, the header members 11 are attached to either side of the core section 24, whereby the opposite sides of the respective tubes 13 and the insertion sections 17*a* of the reinforcement members 17 are retained by the guide tubes 27. As a result, the tubes 13 are fixedly inserted into the corresponding tube holes 11*a* formed in the header member 11, and the insertion sections 17*a* are fixedly inserted into the reinforcement holes 11*b*.

In the above heat exchanger core, the reinforcement holes 11*b* and the tube holes 11*a* are formed so as to be of the same size, and the interval L' between the reinforcement hole 11*b* and the tube hole 11*a* adjacent to the reinforcement hole 11*b* is made equal to the interval L between the adjacent tube holes 11*a*. Therefore, even in the case of the header members 11 having different lengths, the tube holes 11*a* and the reinforcement holes 11*b* can be formed in the header members 11 simultaneously through use of a single die assembly.

More specifically, as shown in FIG. 7, the tube holes 11*a* and the reinforcement holes 11*b* are formed in the header member 11, by means of pressing punching members 31, which are disposed at regular intervals on the upper die 29 in its longitudinal direction, into the header member 11. In the present embodiment, the tube holes 11*a* and the reinforcement holes 11*b* are formed so as to be of the same size, and the interval L' between the reinforcement hole 11*b* and the tube hole 11*a* adjacent to the reinforcement hole 11*b* is made equal to the interval L between the adjacent tube hole 11*a*. As a result, all the punching members 31 can be made of equal size. Even in the case of the header members 11 having different lengths, the tube holes 11*a* and the reinforcement holes 11*b* can be formed in the header member 11 simultaneously.

Further, in the heat exchanger core, the interval T between the linear section 11*d* on the side of the adjacent tube hole 11*a* of the reinforcement hole 11*b* and the end face of the header member 11 is made smaller than a value obtained by adding the size S of a shorter side of the tube hole 11*a* to the interval L between the adjacent tube holes 11*a*. Accordingly, formation of undesired tube holes 11*a* at the end of the header member 11 can be prevented unfailingly.

In the structure of the heat exchanger core described above, the width W4 of the reinforcing section 17*b* of the reinforcement member 17 is made smaller than the width W5 of the corrugated fin 15. The opposite sides of the respective tubes 13 and the insertion sections 17*a* of the reinforcement members 17 can be guided into the tube guides 27. As a result, there can be prevented interference between the reinforcement members 17 and the base member 25 for guiding the corrugated fins 15, which would otherwise be caused Since the insertion sections 17*a* of the reinforcement member 17 that are machined with a high degree of accuracy are guided into the tube guides 25, a displacement between the center of the reinforcement hole 11*b* and the center of the insertion section 17*a*, which would otherwise be caused when the insertion sections 17*a* are inserted into the header members 11, can be diminished to a much greater extent than in the conventional heat exchanger core.

Further, in the structure of the heat exchanger core, the width Wr of the insertion section 17*a* of the reinforcement member 17 is made substantially equal to the width W6 of the tube 13. Hence, the center of the tube hole 11*a* can be made substantially flush with the center of the reinforcement hole 11*b* with respect to the widthwise direction of the header member 11, thereby imparting optimum reinforcement to the tubes 13 from the reinforcement members 17.

In the heat exchanger core, the notches 17*c* are formed on opposite sides of the base end of the insertion section 17*a* of the reinforcement member 17. Hence, even when the width W4 of the reinforcing section 17*b* is set to be smaller than the width Wr of the insertion section 17*a*, the reinforcing section 17*b* can be folded unfailingly.

The chamfered sections 17*d* are formed on opposite sides of the tip end of the insertion section 17*a* of the reinforcement member 17, thereby improving the ease of insertion of the insertion section 17*a* into the reinforcement hole 11*b*.

Under the method of assembling a heat exchanger core, since the insertion sections 17*a* of the reinforcement member 17 that are machined with a high degree of accuracy are guided into the tube guides 25, a displacement between the center of the reinforcement hole 11*b* and the center of the insertion section 17*a*, which would otherwise be caused when the insertion sections 17*a* are inserted into the header members 11, can be diminished to a much greater extent than in the conventional heat exchanger core.

Although the present embodiment has described application of the present invention to the header member 11 comprising a header tank, the present invention is not limited to the present embodiment. For instance, the present invention can be applied to a header member comprising a header plate.

Figure 10:
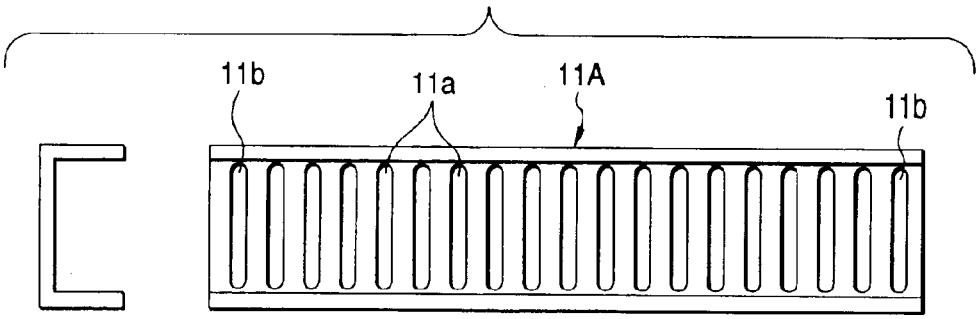
FIG. 10 is a descriptive view showing a header member comprising a header plate.

FIG. 10 shows a header member 11A comprising a header plate. This header member 11A is formed into a C-shaped cross section, and the tube holes 11*a* and the reinforcement holes 11*b* are formed on the bottom of the header member 11A.

Further, the width W5 of the corrugated fin 15 is set larger than the width W6 of the tube 13 in the above embodiment. However, the present invention is not limited to this structure. For example, the present invention can be applied to the heat exchanger core in which the width W5 of the corrugated fin is equal to the width W6 of the tube.

Although the present embodiment has described application of the present invention to an example in which the tube holes 11*a* and the reinforcement holes 11*b* are formed so as to be of the same size, the present invention is not limited to the present embodiment. The tube holes and the reinforcement holes may be formed so as to assume different geometries.

Figure 11A:
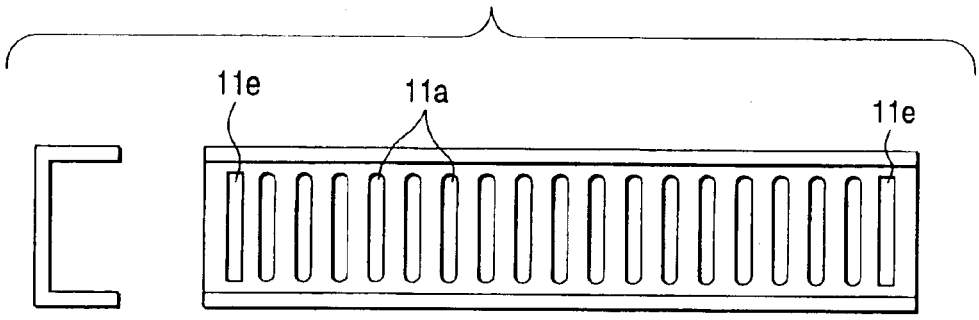
FIGS. 11A and 11B are descriptive views showing other examples of the reinforcement holes formed in the header member.

More specifically, after the tube holes 11*a* and the reinforcement holes 11*b* have been formed to assume an identical geometry, the ends of the reinforcement hole 11*b* are additionally machined into a rectangular shape, as shown in FIG. 11A, to thereby form rectangular reinforcement holes 11*e*.

Figure 11B:
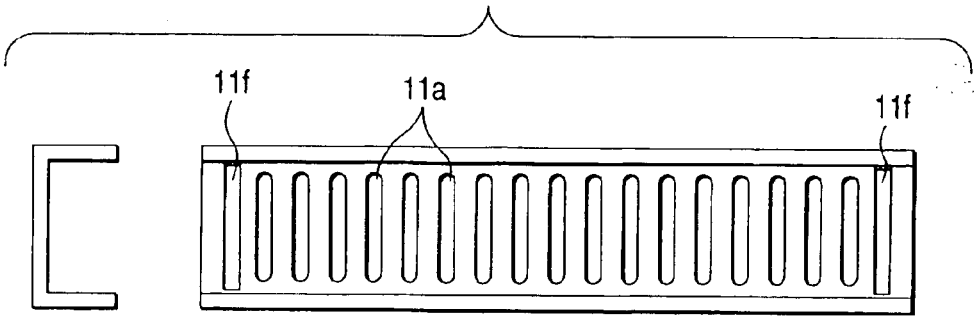

Alternatively, as shown in FIG. 11B, the width of a reinforcement hole 11*f* may be set to be greater than the width of the tube hole 11*a*.

Although the previous embodiment has described the present invention by reference to the example in which the tube holes 11*a* and the reinforcement holes 11*b* are formed after the header members 11 and 11A have been cut to a predetermined length, the present invention is not limited to such an embodiment. The tube holes and the reinforcement holes may be formed before cutting of the header member.

Figure 12:
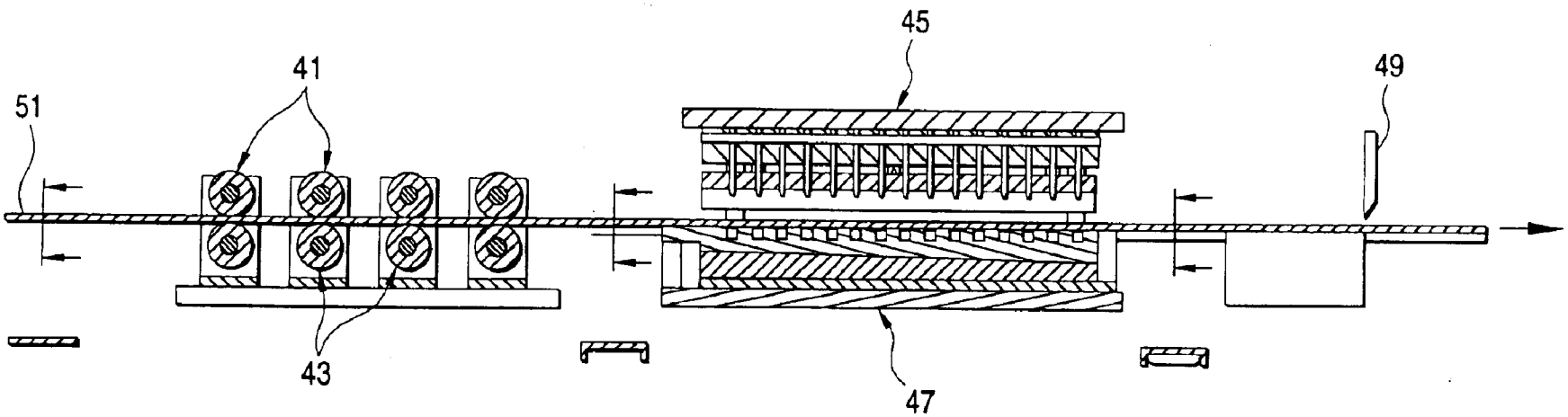
FIG. 12 is a descriptive view showing another example of a method of forming tube holes and reinforcement holes in the header member.
Figure 15:
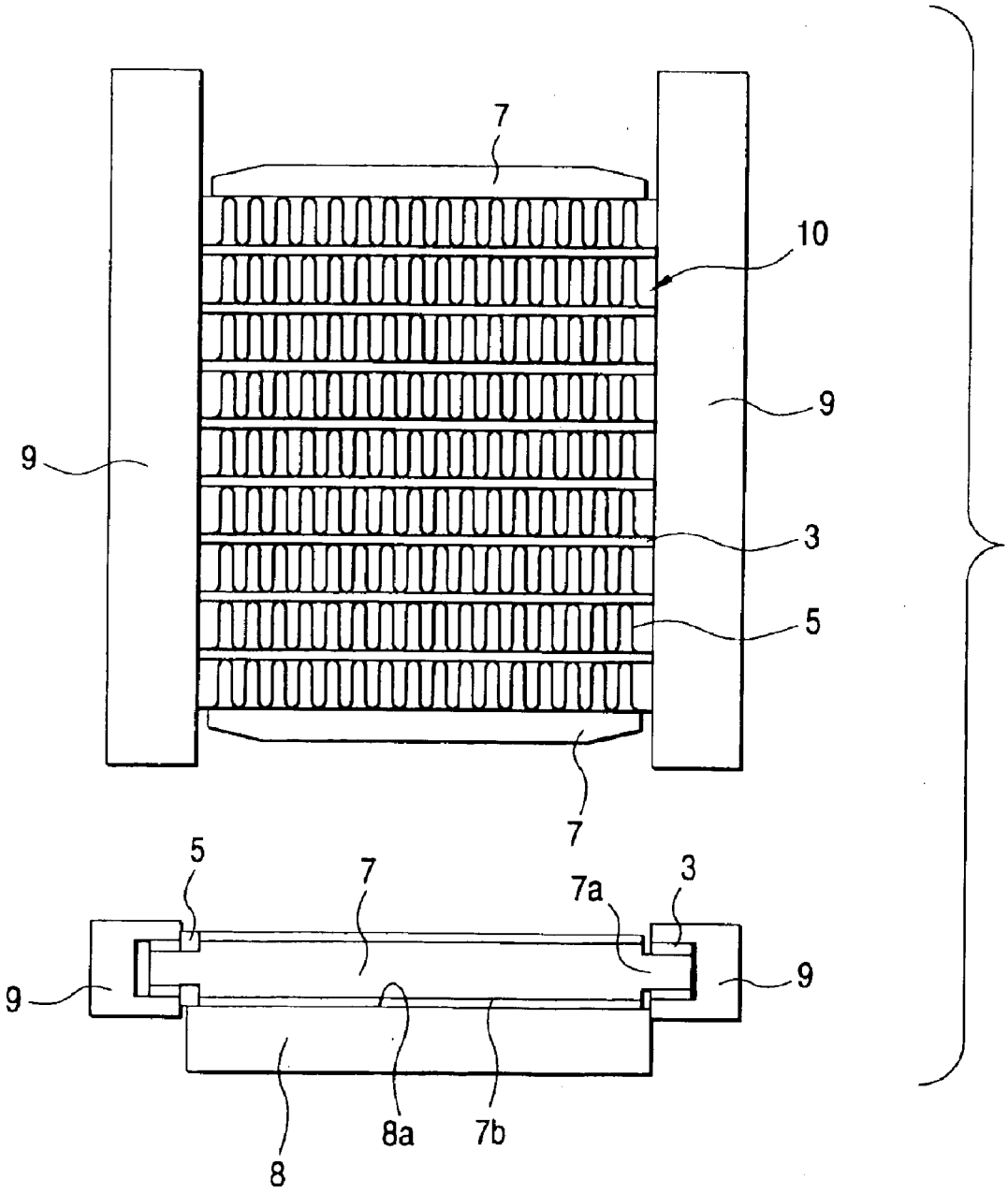
FIG. 15 is a descriptive view showing a process of assembling a conventional heat exchanger core.
Figure 16:
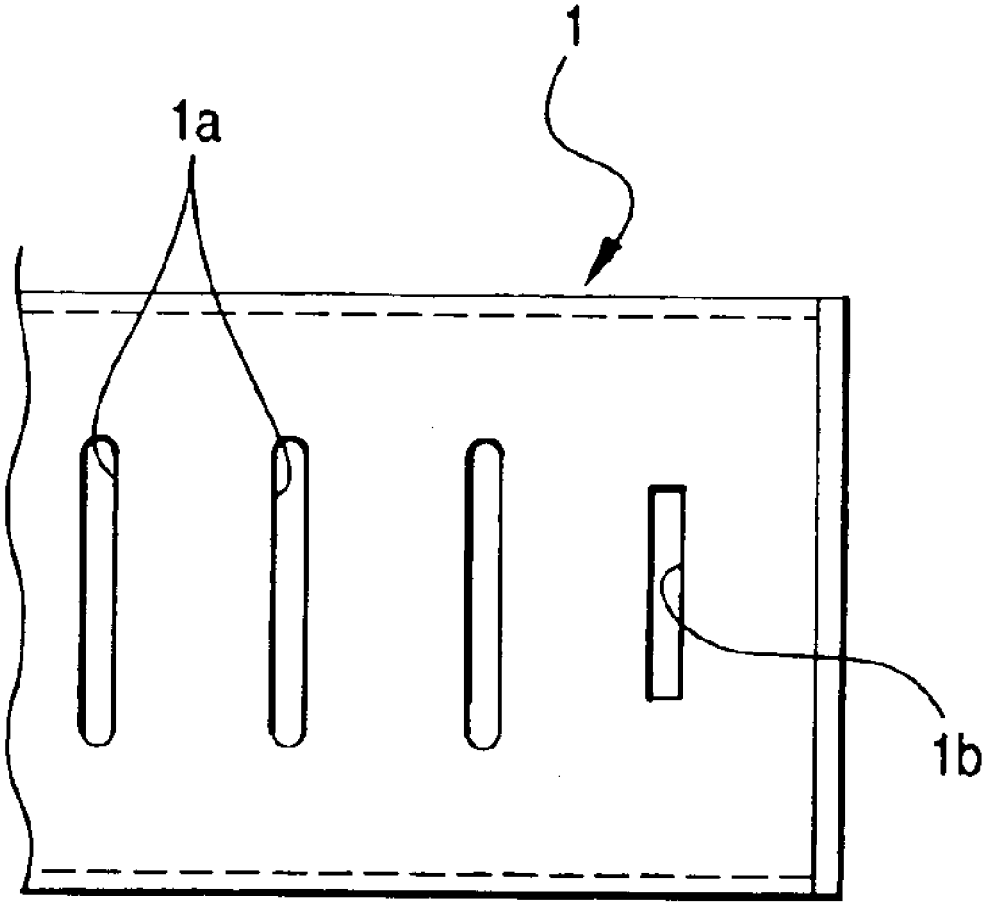
FIG. 16 is a front view showing tube holes and reinforcement holes formed in a conventional header member.

More specifically, as shown in FIG. 12, both ends of plate material 51, the plate being continually supplied at a predetermined speed, are folded so as to assume a C-shaped geometry, by means of an upper rolling die 41 and a lower rolling die 43. The tube holes 11*a* and the reinforcement holes 11*b* may be formed by means of an upper die 45 and a lower die 47, and plate material having a C-shaped geometry may be cut to a predetermined length through use of a cutting blade 49.

Although the present embodiment has described application of the present invention to a radiator, the present invention is not limited to such an embodiment. For instance, the present invention can be applied to a different type of heat exchanger; for example, a condenser.

Although the present embodiment has described the example in which the header member 11 comprising a header tank is formed so as to assume a rectangular cylindrical shape, the present invention is not limited to the present embodiment. For instance, the header member may be formed so as to assume a circular cylindrical shape.

The insertion section 17*a* of the reinforcement member 17 may assume any geometry, so long as the reinforcement hole 11*b* can be completely and hermetically sealed by connecting the insertion section 17*a* into the reinforcement hole 11*b* through brazing.

As has been described above, in the structure of the heat exchanger core of the present invention, the size of the reinforcement hole is formed so as to be greater than the size of the tube hole, and the interval between the reinforcement hole and the tube hole adjacent to the reinforcement hole is made equal to the interval between the adjacent tube holes. As a result, in a case where the header members have different lengths, the tube holes and the reinforcement holes can be simultaneously formed in the header member through use of a fewer number of die assemblies.

In the structure of the heat exchanger core of the present invention, the reinforcement holes and the tube holes are formed so as to be of the same size. As a result, in a case where the header members have different lengths, the tube holes and the reinforcement holes can be simultaneously formed in the header member through use of a single die assembly.

In the structure of the heat exchanger core of the present invention, circular-arch sections are formed at either end of the reinforcement hole, and the end section of the reinforcement member having a rectangular cross section is fitted into the circular-arch sections of the reinforcement hole by press-fitting. The reinforcement member can be sturdily supported on and fitted into the reinforcement hole, thereby improving the brazing characteristic of the reinforcement hole.

In the heat exchanger core of the present invention, the interval between the reinforcement hole and the end face of the header member is made smaller than a value obtained by adding the size of a shorter side of the tube hole to the interval between adjacent tube holes. Accordingly, formation of undesired tube holes at the end of the header member can be prevented unfailingly.

In the heat exchanger core of the present invention, the width of the reinforcing section of the reinforcement member is made smaller than the width of the corrugated fin.

In the heat exchanger core described above, since the width of a reinforcing section is made smaller than the width of a corrugated fin, both ends of tubes and the insertion sections of the reinforcement members can be guided by the tube guides. Therefore, there can be prevented interference between the reinforcement members and a base member for guiding the corrugated fins.

Since the insertion sections of the reinforcement member that are machined with a high degree of accuracy are guided into the tube guides, a displacement between the center of the reinforcement hole and the center of the insertion section, which would otherwise be caused when the insertion sections are inserted into the header members, can be diminished to a much greater extent than in the conventional heat exchanger core.

In the heat exchanger core of the present invention, the width of the insertion section of the reinforcement member is made substantially equal to the width of the tube. Hence, when the opposite sides of the respective tubes and the insertion sections of the reinforcement members are guided by tube guides, the center of the tube hole can be made substantially flush with the center of the reinforcement hole with respect to the widthwise direction of the header member, thereby imparting optimum reinforcement to the tubes from the reinforcement members.

In the heat exchanger core of the present invention, since notches are formed on opposite sides of the base end of the insertion section of the reinforcing section, a reinforcing section can be bent unfailingly.

In the heat exchanger core of the present invention, chamfered sections are formed on opposite sides of the tip end of the insertion section, and hence the ease of insertion of the insertion section into the reinforcement hole can be improved.

According to the method of assembling a heat exchanger core of the present invention, since the insertion sections of the reinforcement member that are machined with a high degree of accuracy are guided into the tube guides, a deviation between the center of the reinforcement hole and the center of the insertion section, which would otherwise be caused when the insertion sections are inserted into the header members, can be diminished to a much greater extent than in the conventional heat exchanger core.

Although the invention has been described in its preferred form with a certain degree of particularity, it is understood that the present disclosure of the preferred form can be arrangement of parts without departing from the spirit and the scope of the invention as hereinafter claimed.

What is claimed is:

1. A heat exchanger core comprising:

a pair of header members being spaced with a predetermined clearance therebetween and disposed opposite to each other;

tubes and corrugated fins which are interposed between said pair of header members and are arranged alternately; and a reinforcement member being provided on ends of said mutually-opposing header members, wherein each of said header members has tube holes into which ends of said tubes are fixedly inserted and reinforcement holes into which ends of said reinforcement members are fixedly inserted, wherein each of said reinforcement holes is formed so as to be of the same size as or larger than each of said tube holes, and wherein an interval between said reinforcement hole and said tube hole adjacent to said reinforcement hole is made equal to an interval between adjacent tube holes, wherein said reinforcement hole comprises continuous circular-arch sections being formed at both ends thereof in a thickness direction and a linear section being formed between said circular-arch sections, and wherein an insertion section is formed at an end of said reinforcement member so as to have an end face being rectangular in cross section and be fixedly inserted into said reinforcement hole, said insertion section having substantially parallel side edges and a constant thickness, and a width of said insertion section is made smaller than a width of said reinforcement hole as well as larger than a width of the linear section so that said insertion section is inserted into said reinforcement hole by press-fitting.

2. A heat exchanger core according to claim 1, wherein each of said tube holes is formed so as to be of the same size as each of said reinforcement holes.

3. A heat exchanger core according to claim 1, wherein an interval between the linear section on a side of the adjacent tube hole of said reinforcement hole and an end face of said header member is made smaller than a value obtained by adding a size of a shorter side of said tube hole to the interval between the adjacent tube holes.

4. A heat exchanger core according to claim 1, wherein said reinforcement member comprises a reinforcing section, wherein a width of said reinforcing section of said reinforcement member is less than a width of said corrugated fins.

5. A heat exchanger core according to claim 1, wherein a width of said insertion section of said reinforcement member is substantially equal to a width of said tubes.

6. A heat exchanger core according to claim 1, wherein said width of said reinforcement hole is larger than said width of said insertion section of said reinforcement member by about 0.2 to 0.4 mm.

7. A heat exchanger core according to claim 1, wherein said reinforcement member comprises a reinforcing section, wherein a width of said reinforcing section is less than a width of said insertion section of said reinforcement member.

8. A heat exchanger core according to claim 1, wherein a width of said reinforcement hole is larger than a width of said tube holes.

9. The heat exchanger core of claim 1, wherein said reinforcement member comprises a reinforcing section having a C-shaped cross section, wherein said reinforcing section faces in a direction away from said tubes and corrugated fins.

10. A heat exchanger core according to claim 1, wherein a width of a widest portion of said insertion section is made smaller than the width of said reinforcement hole, and wherein a width of a narrowest portion of the insertion section is made larger than the width of the linear section.

11. A heat exchanger core comprising:

a pair of header members being spaced with a predetermined clearance therebetween and disposed opposite to each other; and tubes and corrugated fins which are interposed between said pair of header members and are arranged alternately, a reinforcement member being provided on ends of said mutually-opposing header members, wherein each of header members has tube holes into which ends of said tubes are fixedly inserted and reinforcement holes into which ends of said reinforcement members are fixedly inserted, said reinforcement member comprises a reinforcing section having a C-shaped cross section and insertion sections which are integrally formed with opposite ends of said reinforcing section, said insertion section having substantially parallel side edges and a constant thickness, said reinforcement member having a substantially constant width, the substantially constant width being smaller than a width of said corrugated fin, and a width of said tubes is smaller than said width of said corrugated fin, said insertion section having a base end section adjacent said reinforcing section, wherein notches are formed on opposite sides of said base end section and adjacent said reinforcing section, wherein each of said notches are formed at an angle of 15 to 60 degrees and a depth of 0.5 to 1.5 mm.

12. A heat exchanger core according to claim 11, wherein a width of said insertion section of said reinforcement member is substantially equal to a width of said tube.

13. A heat exchanger core according to claim 11, wherein chamfered sections are formed on opposite sides of a tip end of said insertion section.

14. A heat exchanger core according to claim 11, wherein a width of said reinforcement hole is larger than a width of said end of said reinforcement member.

15. A heat exchanger core according to claim 14, wherein said width of said reinforcement hole is larger than said width of said end of said reinforcement member by about 0.2 to 0.4 mm.

16. A heat exchanger core according to claim 11, wherein a width of said reinforcement hole is larger than a width of said tube holes.

* * * * *